US009903569B2

(12) United States Patent
O'Brien et al.

(10) Patent No.: US 9,903,569 B2
(45) Date of Patent: Feb. 27, 2018

(54) LED MODULE AND ASSEMBLY

(71) Applicant: CORDELIA LIGHTING, INC., Rancho Dominguez, CA (US)

(72) Inventors: Aaron O'Brien, Los Alamitos, CA (US); Huan C. Nguyen, Placentia, CA (US); Seth Chang, Rowland Heights, CA (US); James Madden, Philadelphia, PA (US)

(73) Assignee: CORDELIA LIGHTING INC., Rancho Dominguez, CA (US)

( * ) Notice: Subject to any disclaimer, the term of this patent is extended or adjusted under 35 U.S.C. 154(b) by 36 days.

(21) Appl. No.: 15/174,778

(22) Filed: Jun. 6, 2016

(65) Prior Publication Data

US 2016/0356462 A1 Dec. 8, 2016

Related U.S. Application Data

(60) Provisional application No. 62/172,020, filed on Jun. 5, 2015.

(51) Int. Cl.

| | |
|---|---|
| ***F21V 21/02*** | (2006.01) |
| ***F21K 9/66*** | (2016.01) |
| ***F21V 29/83*** | (2015.01) |
| ***F21K 9/68*** | (2016.01) |
| ***F21V 17/16*** | (2006.01) |
| ***F21V 17/00*** | (2006.01) |
| ***F21V 23/00*** | (2015.01) |
| ***F21V 19/00*** | (2006.01) |
| *F21Y 115/10* | (2016.01) |

(52) U.S. Cl.

CPC ..... *F21V 21/02* (2013.01); *F21K 9/66* (2016.08); *F21K 9/68* (2016.08); *F21V 17/002* (2013.01); *F21V 17/16* (2013.01); *F21V 19/004* (2013.01); *F21V 23/005* (2013.01); *F21V 29/83* (2015.01); *F21Y 2115/10* (2016.08)

(58) Field of Classification Search

CPC ..... F21V 21/02; F21V 29/83; F21V 17/002; F21V 17/16; F21V 19/004; F21K 9/66; F21K 9/68

See application file for complete search history.

(56) References Cited

U.S. PATENT DOCUMENTS

| | | | |
|---|---|---|---|
| 8,201,968 | B2 | 6/2012 | Maxik et al. |
| 8,672,518 | B2 | 3/2014 | Boomgaarden et al. |

(Continued)

FOREIGN PATENT DOCUMENTS

| | | |
|---|---|---|
| CN | 203162725 | 8/2013 |
| CN | 203868852 | 10/2014 |
| WO | 2008137732 A1 | 11/2008 |

*Primary Examiner* — Thomas M Sember

(74) *Attorney, Agent, or Firm* — Paul Y. Feng; One LLP

(57) ABSTRACT

An LED light module assembly for a light fixture is disclosed. The LED light module assembly includes a light source having a printed circuit board containing an LED driver and LEDs. The printed circuit board is directly attached to a mounting plate that includes a thermally conductive and radiating material. An LED cover overlies the LEDs. Spring retainer clips hold a decorative trim ring in a spaced-apart relationship from the mounting plate, creating an air gap for cooling and keeping the trim ring cool. A light diffuser lens has hooked legs that twist lock to the mounting plate and diffuses the light from the LEDs.

22 Claims, 3 Drawing Sheets

(56) References Cited

U.S. PATENT DOCUMENTS

| | | | | |
|---|---|---|---|---|
| 8,967,844 | B2 | 3/2015 | Boomgaarden et al. | |
| 2008/0285271 | A1* | 11/2008 | Roberge | F21S 8/033<br>362/235 |
| 2009/0086474 | A1 | 4/2009 | Chou | |
| 2016/0281939 | A1* | 9/2016 | Luk | F21S 8/026 |

* cited by examiner 30
34
30
16
10

34
10

16
12
28
14
14

30
22
32
20
16
24
32
10

22
30
32
16
20
24

30

24
22

LED MODULE AND ASSEMBLY

CROSS-REFERENCE TO RELATED APPLICATIONS

This application claims benefit of priority to provisional application No. 62/172,020, filed Jun. 5, 2015, the contents of which are hereby incorporated by reference.

FIELD OF THE INVENTION

The present invention relates to residential and commercial lighting fixtures. In particular, the present invention relates to an LED light module assembly.

BACKGROUND OF THE INVENTION

Currently, for a greener environment, industry movement is toward using Light Emitting Diodes (LEDs) as a light source to replace the incandescent bulbs, halogen bulbs, and CFLs. LEDs dramatically save on power consumption and electricity bills, and their extended duty life of 50,000 hours is a great improvement over conventional light sources that last perhaps a year or two and burn out. Such LED light fixture implement what is known as an LED light engine. The LED light engine is loosely defined as an integrated assembly made from LED packages (components) or LED arrays, an LED driver, and other optical, thermal, mechanical and electrical components. The LED light engine is intended to connect directly to the branch circuit through a connector compatible with the LED light fixture for which it was designed.

Early LED light fixtures were designed with dedicated LEDs permanently integrated into the fixture. Because the LEDs were dedicated components, it was easier for the designers to control the outflow of the heat generated by early LEDs, to optimize lumens output by the LEDs, and to extend the LED life. Thermal management is important in LED lighting fixtures since it impacts the life and reliability of the LEDs, the efficiency of lumens generated versus energy consumed by the LEDs, and the risk of generating a fire in the fixture.

SUMMARY OF THE INVENTION

Mindful of the design parameters, the lighting industry has evolved, and one approach is to use replaceable LED modules and retrofit kits having good thermal conduction paths. In a preferred embodiment, the present invention is directed to an LED light module assembly for direct attachment to an electrical junction box having a side opening. The LED light module assembly comprises a light source including an LED driver and a printed circuit board with at least one LED disposed thereon; a mounting plate having a top surface and a bottom surface and including a thermally conductive material, wherein the printed circuit board is directly mounted and abuts to the bottom surface of the mounting plate for thermal conduction therebetween, wherein the top surface of the mounting plate directly engages with the junction box at the side opening, and wherein the mounting plate includes uncovered areas on the top and bottom surfaces to radiate heat; a retainer means disposed on the mounting plate and extending away from the bottom surface of the mounting plate; and an LED cover engaging the mounting plate, overlying the at least one LED, wherein the LED cover includes a light transmissive and reflective material.

The preferred embodiment LED light module assembly optionally includes a trim ring having an open center area exposing the LED cover, wherein the trim ring engages the retainer means which spaces the trim ring away from the mounting plate creating a circumferential air gap therebetween. The mounting plate preferably includes a thermal conductive material selected from, e.g., a metal, a polymer, and/or a ceramic. The LED light module may further include a light transmissive and reflective diffuser, usually made of glass or plastic, overlying the LED cover and engaging the retainer means. The light diffuser includes feet with hooks that engage slots in the mounting plate for a twist-lock type attachment. In the preferred embodiment, the retainer means includes spring clips, but may be springs, fasteners, hooks, coiled springs, and the like. A quick disconnect brings electrical power from the junction box down to the LED light module.

The mounting plate is preferably a flat sheet of material and may have a polygonal shape, a circular shape, or a combination of both. The shape and size are selected to complement most standard electrical junction boxes. The LED cover may have a circular shape with a diameter much greater than a height thereof, to create a low profile.

Further, the preferred embodiment contemplates a junction box adapter that is fitted between the mounting plate and the junction box. The adapter helps with fitment of the LED module to varying sizes and shapes of electrical junction boxes existing in the industry. As such, the junction box adapter may have a square shape with an open center, an L-shape, a boomerang shape, or the like.

Accordingly, the present invention LED light module assembly is modular, so it along with its major components like the light diffuser and trim ring are easily swapped out by the consumer.

BRIEF DESCRIPTION OF THE DRAWINGS

FIG. 5(*a*)-(*c*) are top, side elevational, and bottom views of the completed installation fixture from FIG. 4. FIG. 5(*d*) is a cross-sectional view of the light fixture taken along line A-A in FIG. 5(*b*). FIG. 5(*e*) is a partial, magnified view of FIG. 5(*d*). FIG. 5(*f*) is a perspective top view of the fixture. FIG. 5(*g*) is a perspective bottom-looking-up view of the fixture.

FIGS. 9(*b*) and 9(*c*) are exploded views, top and bottom, respectively, of the LED light module and light diffuser assembly.

DETAILED DESCRIPTION OF THE PREFERRED EMBODIMENTS

Figure 1:
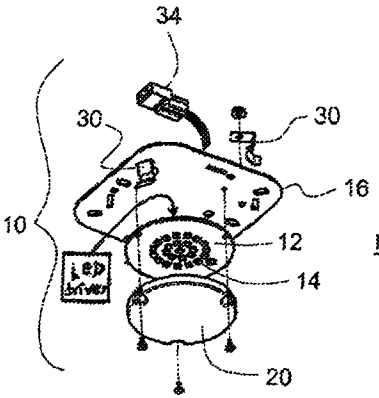
FIG. 1 is an exploded view of a preferred embodiment LED light module assembly.

As seen in FIG. 1, the present invention in a preferred embodiment is directed to an LED light module 10 that is incorporated into disc light fixture mounted to a ceiling, a wall, or like flat surface of a room in a residence or a commercial facility. In the preferred embodiment, an LED PCB (Printed Circuit Board) 12 contains one or more LEDs 14 as needed per application arranged preferably at the center of PCB 12 and an LED driver (not shown). The LEDs 14 are generally arranged in a pattern and clustered about the center of the PCB 12, which is typically circular. The LEDs 14 are arranged in FIG. 1 in concentric circles but other patterns are contemplated.

The PCB/PCBA (Printed Circuit Board Assembly) 12 is mounted in direct contact with a mounting plate 16 to improve thermal conductivity between the two structures. The PCBA 12 contains standard electrical components (such as the LED driver) needed to control the input wall plug power for consumption by the LEDs 14. The PCBA 12 is securely mounted to the mounting plate 16. The PCBA 12 makes contact with the mounting preferably directly (or optionally indirectly as needed) to secure the PCBA 12 thereto.

A quick disconnect 34 extending from the top surface of the mounting plate 16 brings electrical power down to the LED module 10 from the junction box 18. Several fasteners 44 are used to attach the LED light module to 10 to the junction box 18.

To manage the heat generated from the PCBA 12 and LEDs 14, it is preferred that there be direct, abutting contact between the PCBA 12 and the mounting plate 16. This ensure thermal conduction and heat transfer from the hotter PCBA 12/LEDs 14 to the relatively cooler mounting plate 16. From empirical observations, such a construction of the mounting plate 16 and its direct assembly to the PCBA 12 provide efficient cooling for the light engine.

Figure 2:
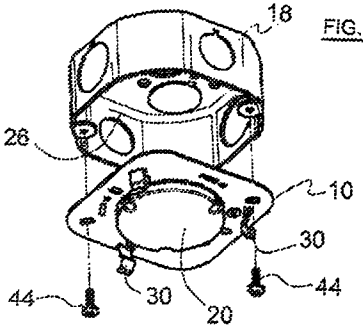
FIG. 2 shows a step for installing the LED light module assembly to a standard junction box.

The mounting plate 16 is preferably the structure also used to secure the PCBA 12 to the electrical junction box 18 as seen in FIG. 2. The mounting plate 16 can be made from a flat sheet of plastic, metal, ceramic, a combination of such materials, or any material suitable to hold the weight of the fixture and to prevent the spread of fire. The mounting plate 16 should have sufficient rigidity and strength to provide structural support for the PCBA 12, an LED cover 20, a trim ring 22, and a light diffuser 24. See FIGS. 1-4.

The preferred shape of the mounting plate 16 is preferably a square and sized as shown to complement and/or cover the shape and size of an open side 26 of a standard electrical junction box 18, in FIG. 2. The size and shape of the mounting plate 16 preferably completely covers the open side 26 of the junction box 18. In alternative embodiments, the shape could be a diamond, triangle, rectangle, or a derivative of those shapes so designed to minimize scrap in the manufacturing process and to help dissipate heat from the LEDs, LED driver, and PBCA. Polygons such as a hexagon, octagon, trapezoid, are also contemplated, as well as round shapes such as an oval, circle, semicircle, and the like.

The material used to fabricate the mounting plate 16 should preferably be a thermal conductor and thermal radiator. Its shape is preferably a polygon having dimensions preferably suited to cover a 3.5-inch, standard octagonal junction box 18 as in FIG. 2. The dimensional size and mass should be sufficient to conduct and dissipate heat. Furthermore, as seen in FIGS. 1 and 5, the bottom surface and the top surface of the mounting plate 16 are generally uncovered by hardware (except by the PCBA 12), further improving its effectiveness in heat radiation and convection cooling into and by the ambient air. In the preferred embodiment, the overall size (area) of the printed circuit board is much smaller than the overall size (area) of the mounting plate 16 such that the much of the mounting plate has surface area uncovered by the printed circuit board 12 or any other hardware. Thus, the mounting plate 16 may function as a heat dissipator for the LED module 10 when needed to help radiate the heat along the x, y, and z axes.

Figures 5A, 5B, 5C, 5D, 5E, 5F, 5G, 6:
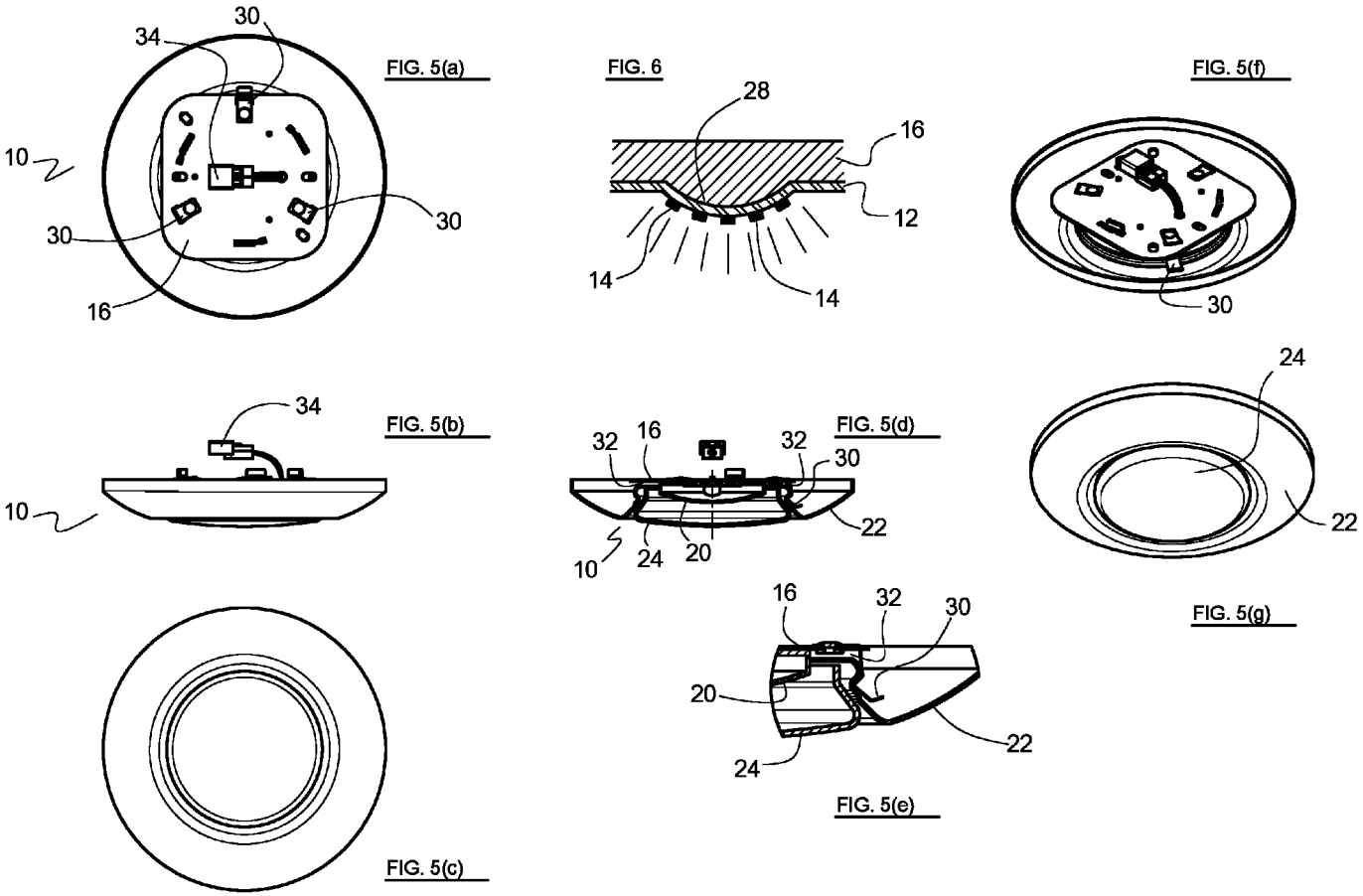
FIG. 6 is a cross-sectional view of a convex contour in the mounting plate.

In an alternative embodiment shown in FIG. 6, the mounting plate 16 may have recesses or contours 28 to which the PCBA 12 is mounted to help aim or distribute the emitted LED light. The mounting plate 16 in such embodiment may have a convex center 28, so when the PCBA 12 which itself may be a relatively flexible material, is mounted on the convex center 28, the PCBA 12 conforms to the convex shape. Following the convex contour profile, the LEDs 14 are thus aimed radially outward giving a hemispherical illumination pattern. Other contour shapes are contemplated, such as a peg, pillbox, pyramid, concave recess, ridge, parallel corrugations, etc. In still another alternative embodiment, the LED packages 14 may be mounted to the contours of the mounting plate instead of the PCB 12 (not shown), or the contours may be formed in the PCB to aim the LEDs.

FIGS. 1-4 show the optional LED cover 20, which is made from a material that transmits visible light and reflects light. In preferably has a low profile, flattened dome shape. It can be transparent or translucent, made in any color, and formed from glass, plastic, or the like. The LED cover 20 also serves as a heat and flame barrier when needed and an environmental barrier keeping out a corrosive environment, insects, dust, and moisture. The LED cover 20 is preferably attached to the mounting plate 16 by fasteners such as screws, rivets, a bonding agent, or the like. By selection of material, surface finish, contours, the LED cover 20 can be designed to improve light distribution and uniformity along with blending the appearance of the LED's so that the end user does not see the individual LEDs. It may also make contact with or mounted to the PCBA 12 if needed to reduce fastener use.

Retainer means preferably in the form of several retainer spring clips 30 are used to hold the major components together. As seen in FIGS. 1, 5(*d*), and 5(*e*), several spring clips 30 are clipped, hooked, bonded, or otherwise fastened to the mounting plate 16. The spring clips 30 are preferably made from spring steel, a resilient plastic, or the like, and extend away from the mounting plate 16 as receiving arms. The spring clips 30 include a hook in their elongated shape and further exhibit a spring bias. As arranged in a circle, there is an inward spring bias that helps latch the hooks against a ridge or lip formed along the inside diameter of the trim ring 22 thereby holding the trim ring 22 in place. This is best seen in the cross-sectional views of FIGS. 5(*d*) and 5(*e*).

The spring clips 30 are arranged around the periphery of the mounting plate 16 in a spaced apart arrangement to reduce thermal conduction between the mounting plate 16 and the trim ring 22. The spaced apart arrangement further creates a circumferential air gap 32, best seen in FIGS. 5(*d*) and 5(*e*), between the hotter mounting plate 16 and the cooler trim ring 22. Consequently, the air gap 32 minimizes how hot the trim ring 22 becomes and makes the trim ring 22 safe to touch even when the LED light fixture is energized and has been on for a long duration. Further, the circumferential air gap 32 allows the mounting plate 16 to dissipate heat through air convection, with minimal heat transfer to the trim ring 22. The spring clips 30 may be removable and may optionally have additional thermal insulator washers (not shown) between the spring clips and mounting plate to further thermally isolate the spring clips from heat conduction.

The optional trim ring 22 is a cosmetic structure that helps to cover the junction box hole and the mounting plate 16. It provides a cosmetically pleasing appearance similar to a conventional recessed down light trim ring. Its shape and design are not limited to the embodiment shown in the drawings. It could be square, round, hexagonal or any shape that would help cover the ceiling opening and other visually undesirable features (e.g., unevenly cut edges of the hole in the ceiling or wall surface).

The height of the trim ring 22 is flexible at the design stage, allowing for thicker versions to look more like surface mount fixtures or thinner to appear more low profile. The trim ring can be made from any material that can support its own weight, such as metals, glass, plastics, cellulose, ceramics, fiberglass, earth materials such as clay, or organic materials such as composted leaves. This is basically a decorative item which serves to dress up the area on the ceiling where the hole was made to bring in power behind the ceiling or wall. As such, the trim ring may have surface contours or patterns, include air vents, and may have surface coatings or decorative finishes. As described in the preferred embodiment, the trim ring snaps into place or can be detached, and no tools are required; the trim ring fits flush against the ceiling or wall surface. Since this is an independent component, it can be detached, painted in the field, or modified without disturbing the electrical work.

Figure 4:
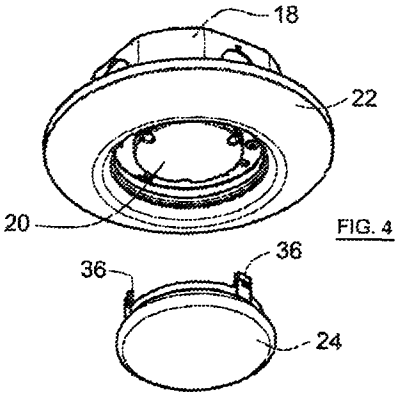
FIG. 4 shows another step of installing a light diffuser lens to the LED module.

To complete the installation, an optional light diffuser or lens 24 is used to diffuse and reflect LED emitted light and help make the final installation achieve the finished look that many end users desire. This is shown in FIG. 4. The preferred light diffuser lens 24 may be round, flat, conical, domed, mushroom-shaped, torroidal, v-shaped or any version needed to provide the end user with the look he or she prefers. Preferably, the light diffuser lens 24 has legs 36 with hooks at the distal ends. The legs 36 are inserted through receiving slots in the mounting plate 16, and a twist by the user or electrician, this rotational motion locks the diffuser lens 24 in place.

Other fastening mechanisms are contemplated to secure the diffuser lens, such as using clips, springs, screw threads, snap fits, friction fits, etc. In the preferred embodiment, the diffuser lens installs without fasteners. Its color and diffusion can be adjusted as needed by the selecting its shape, wall thicknesses, surface contours, material color, opacity, transmissivity, reflectivity, etc. to suit the end user's needs. The diffuser lens can be made from any visible light transmissive material that can be formed into a shape suitable for attachment to the present invention light fixture. This would include, but not be limited to, the following: glass, plastic, and laminates of these or other materials such as mica or ceramic.

Figure 9A:
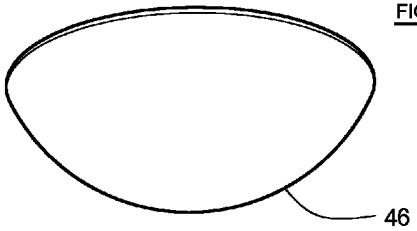
FIG. 9(*a*) is a bottom perspective view looking up at the LED light module attached to a light diffuser assembly.
Figure 9B:
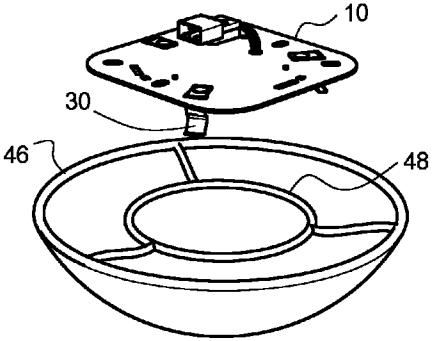
Figure 9C:
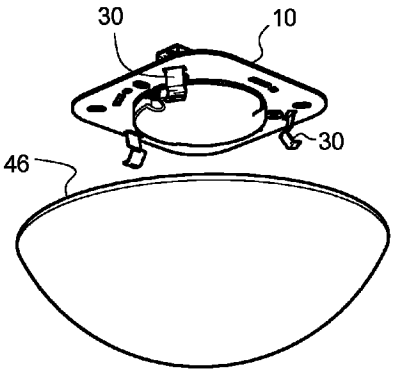

In an alternative embodiment, the LED light module assembly has a different mechanism to mount the light diffuser or trim ring. Specifically, the assembly includes an additional/secondary mounting plate. The secondary plate holds a flush mount lens assembly with optional springs provided on the secondary plate. The springs could hold any combination of lenses, diffusers or cosmetic assemblies designed to be supported by the secondary plate and spring assembly. FIG. 9 shows one such alternative embodiment. Exploded views FIGS. 9(*b*) and 9(*c*) show the LED light module 10 and a flush mount lens/light diffuser assembly 46 which is translucent/transparent. As best seen in FIG. 9(*b*), inside the light diffuser assembly 46 is a secondary mounting plate, here a wire frame 48. The spring clips 40 hook onto the wire frame 48 to hold the light diffuser assembly 46 against the LED light module 10 attached to the junction box. By this same attachment mechanism, the light diffuser assembly is held against the wall or ceiling. Coiled springs, screws, and like fasteners in combination with a plate, for example, may be used instead or in addition to the wire frame. Also, the light diffuser assembly 46 may be a light diffusing lens only, a trim ring only, or a combination of both.

The outside diameter of the light diffuser assembly 46 is greater than the size of the LED light module assembly, the junction box, or the hole in the ceiling or wall containing the junction box. Thus, the light diffuser assembly entirely covers and hides from view the hardware and open hole. When installed to the ceiling, the entire LED light fixture has a low profile, flush mount appearance.

Indeed, because the LED module 10 and hardware are recessed into the junction box 18, the diffuser lens 24 may be completely or partially recessed into the trim ring 22, giving the fixture a low profile appearance. In other words, the fixture height extending down into the room beyond the ceiling surface (or wall surface) can be very small, giving the fixture a sleek appearance. This is a result of the present invention fixture being packaged very efficiently in the z-direction. In smaller living quarters, or where the living space has a lower ceiling, the low profile packaging of the present invention fixture minimizes the height intrusion or encroachment into the living area. This gives the room occupants more of an open air environment, even though the room may be small and the ceiling may be low.

It is contemplated that the present invention LED module 10 may be sold by itself so that the end user can replace an existing LED light module that may have burned out, or if the user desires a higher lumens output, etc. It can be easily swapped out by the end user because of use of the spring clips 30 holding the major components together, and the quick disconnect 34 for wiring to the junction box 18. As stated earlier, the trim ring 22 and the light diffuser lens 24 are all easily detachable and can be swapped out by the user without much effort.

Figure 3:
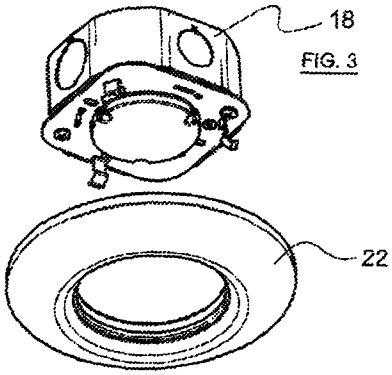
FIG. 3 shows another step for installing a trim ring to the LED light module.
Figure 8:
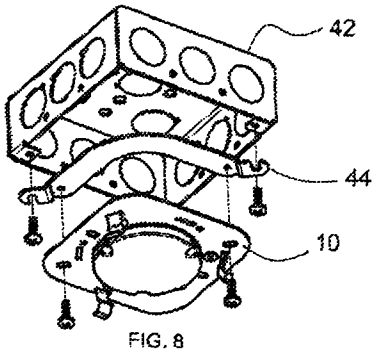
FIG. 8 is an exploded view of the LED light module attached to a larger J-box with an L-shaped or boomerang shaped adapter.
Figure 7:
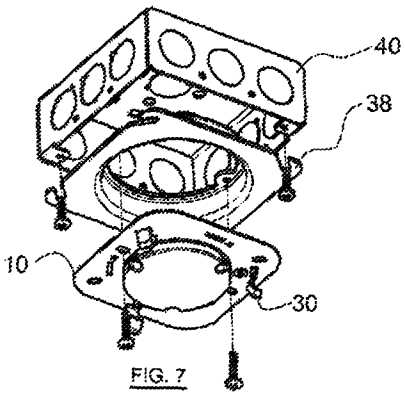
FIG. 7 is an exploded view of the LED light module attached to a 4×4 J-box using an adapter.

As seen in FIGS. 2-4, PCBA 12 and mounting plate 16 are attached securely to a standard 3.5-inch octagonal junction box 18. For other sizes and shapes of junction boxes, the present invention contemplates a square "mud ring" J-box adapter 38 to be used for mounting the LED module 10 to a square-shaped 4×4 J-box 40, as seen in FIG. 7. In FIG. 8, if the consumer wants to use a larger junction box 42, a J-box adapter bracket 44 in the shape of a boomerang or "L" is used to mate the mounting plate to the larger J-box. The L-shape would have more of an angle bend while the boomerang shape has a gentle curve. As seen in FIGS. 7, 8, LED module 10 fits to the respective adapter 38, 44, while the adapter fits to the J-box 40, 42, all the while ensuring the fastener holes align.

Wiring between the LED module and the input power is completed before fastening the LED module to the junction box. The preferred embodiment LED module 10 uses an electrical quick disconnect 34 which would reduce future maintenance labor. Unlike many LED assemblies, this assembly is not exposed when the installation is complete, because the structures are recessed into the J-box, and they become internal components of the J-box.

While particular forms of the invention have been illustrated and described, it will be apparent that various modifications can be made without departing from the spirit and scope of the invention. It is contemplated that components from one embodiment may be combined with components from another embodiment.

What is claimed is:

1. An LED light module assembly for direct attachment to an electrical junction box having a side opening, comprising:

a light source including an LED driver and a printed circuit board with at least one LED disposed thereon;

a mounting plate having a top surface and a bottom surface and including a thermally conductive material, wherein the printed circuit board is directly mounted to the bottom surface of the mounting plate for thermal conduction therebetween, wherein the top surface of the mounting plate engages with the junction box at the side opening, and wherein the mounting plate includes uncovered areas on the top and bottom surfaces to radiate heat;

a retainer means disposed on the mounting plate and extending away from the bottom surface of the mounting plate; and an LED cover engaging the mounting plate, overlying the at least one LED, wherein the LED cover includes a light transmissive and reflective material; and a trim ring having an open area exposing the LED cover, wherein the trim ring engages the retainer means to be spaced apart from the bottom surface of the mounting plate leaving a gap between the bottom surface of the mounting plate and the trim ring.

2. The LED light module assembly of claim 1, wherein the mounting plate includes a surface contour and the printed circuit board conforms to the surface contour.

3. The LED light module assembly of claim 1, wherein the thermal conductive material of the mounting plate includes a sheet of at least one of a metal, a polymer, and a ceramic.

4. The LED light module assembly of claim 1, wherein the assembly includes a light transmissive and reflective diffuser overlying the LED cover and engaging the retainer means.

5. The LED light module assembly of claim 4, wherein the mounting plate includes slots and the light diffuser includes feet with hooks that engage the slots for a twist lock attachment.

6. The LED light module assembly of claim 1, wherein the retainer means includes spring clips.

7. The LED light module assembly of claim 1, wherein the mounting plate includes one of a polygonal shape and a circular shape.

8. The LED light module assembly of claim 1, wherein the LED cover includes a circular shape with a diameter much greater than a height thereof.

9. The LED light module assembly of claim 1, wherein the assembly includes a junction box adapter fitted between the mounting plate and the junction box, wherein the junction box adapter includes at least one of a square shape with an open center, an L-shape, and a boomerang shape.

10. An LED light module assembly for direct attachment to an electrical junction box having a side opening, comprising:

a light source including an LED driver wired to a printed circuit board to energize a plurality of LEDs;

a mounting plate having a top surface and a bottom surface, the mounting plate including a thermally conductive material, wherein the printed circuit board directly abuts the bottom surface of the mounting plate for thermal conduction therebetween, wherein the top surface of the mounting plate directly abuts with the junction box at least partially covering the side opening, and wherein the mounting plate functions as a heat sink;

a retainer means disposed on the bottom of the mounting plate and extending away from the bottom surface of the mounting plate;

an LED cover engaging the mounting plate, overlying the plurality of LEDs; and a detachable trim ring engaging the retainer means such that there is a circumferential air gap between the bottom surface of the mounting plate and the trim ring.

11. The LED light module assembly of claim 10, wherein the mounting plate is a flat sheet including a material selected from the group consisting of metal, polymer, or ceramic.

12. The LED light module assembly of claim 10, wherein the printed circuit board is circular shaped and the plurality of LEDs are arranged in concentric circles about a center of the printed circuit board.

13. The LED light module assembly of claim 10, wherein the assembly includes a junction box adapter fitted between the mounting plate and the junction box, wherein the junction box adapter includes at least one of a square shape with an open center, an L-shape, and a boomerang shape.

14. The LED light module assembly of claim 10, wherein the assembly includes a plurality of fasteners that pass through the mounting plate and attach to the junction box.

15. The LED light module assembly of claim 10, wherein the mounting plate includes contours that create contours in the printed circuit board.

16. The LED light module assembly of claim 10, wherein the assembly includes a light diffuser that is disposed over the LED cover.

17. An LED light module assembly for direct attachment to an electrical junction box having a side opening, comprising:

a light source including an LED driver wired to a printed circuit board to energize a plurality of LEDs;

a flat, disk shaped mounting plate with a top surface and a bottom surface, the mounting plate including a thermally conductive material;

wherein the printed circuit board directly abuts the bottom surface of the mounting plate for thermal conduction therebetween;

wherein an overall size of the printed circuit board is less than an overall size of the mounting plate such that the mounting plate has greater surface area uncovered by the printed circuit board;

wherein the top surface of the mounting plate directly engages with the junction box covering the side opening;

a retainer means disposed on the bottom of the mounting plate and extending away from the bottom surface of the mounting plate; and a rigid, protective LED cover made of light transmissible material engaging the mounting plate, overlying the plurality of LEDs.

18. The LED light module assembly of claim 17, wherein the assembly includes a detachable trim ring, connected by the retainer means to be spaced apart from the bottom surface of the mounting plate leaving a circumferential air gap between the trim ring and the bottom surface.

19. The LED light module assembly of claim 17, wherein the mounting plate includes a convex contour, and illumination from the plurality of LEDs on the printed circuit board are aimed by the convex contour.

20. The LED light module assembly of claim 17, wherein the mounting plate fully covers the side opening of the junction box.

21. The LED light module assembly of claim 17, wherein the assembly includes a junction box adapter fitted between the mounting plate and the junction box, wherein the junction box adapter includes at least one of a square shape with an open center, an L-shape, and a boomerang shape.

22. The LED light module assembly of claim 17, wherein the assembly includes a diffuser lens assembly including an internal frame attached to the retainer means.

* * * * *